US006908544B2

(12) United States Patent
Yu et al.

(10) Patent No.: US 6,908,544 B2
(45) Date of Patent: Jun. 21, 2005

(54) CRACKING CATALYST COMPRISING LAYERED CLAYS AND A PROCESS FOR CRACKING HYDROCARBON OILS USING THE SAME

(75) Inventors: Zhiqing Yu, Beijing (CN); Zhijian Da, Beijing (CN); Zhenyu Chen, Beijing (CN); Enze Min, Beijing (CN); Jun Long, Beijing (CN); Caiying Li, Beijing (CN); Zhiqing Huang, Beijing (CN)

(73) Assignees: China Petroleum & Chemical Corporation, Beijing (CN); Research Institute of Petroleum Processing,, Sinopec (CN)

( * ) Notice: Subject to any disclaimer, the term of this patent is extended or adjusted under 35 U.S.C. 154(b) by 88 days.

(21) Appl. No.: 10/327,122

(22) Filed: Dec. 24, 2002

(65) Prior Publication Data

US 2003/0159972 A1 Aug. 28, 2003

(30) Foreign Application Priority Data

Dec. 25, 2001 (CN) ..... 01144959 A
Dec. 25, 2001 (CN) ..... 01144960 A

(51) Int. Cl.[7] ..... B01J 29/06

(52) U.S. Cl. ..... 208/120.01; 208/118; 208/119; 208/120.1; 502/68; 502/80; 502/84; 502/77; 502/79

(58) Field of Search ..... 502/68, 80, 84, 502/77, 79; 208/120.01, 118, 119, 120.1

(56) References Cited

U.S. PATENT DOCUMENTS

| | | | | |
|---|---|---|---|---|
| 4,333,857 A | | 6/1982 | Lim et al. | |
| 4,757,040 A | * | 7/1988 | Guan et al. | 502/63 |
| 5,214,012 A | | 5/1993 | Suzuki et al. | |
| 5,369,069 A | | 11/1994 | Suzuki et al. | |
| 5,958,819 A | | 9/1999 | Johnson et al. | |
| 6,214,211 B1 | | 4/2001 | Itoh | |
| 6,303,531 B1 | | 10/2001 | Lussier et al. | |
| 6,342,153 B1 | * | 1/2002 | Guan et al. | 208/118 |

FOREIGN PATENT DOCUMENTS

| | | | |
|---|---|---|---|
| CN | 86101990 | | 10/1987 |
| CN | 1031029 | * | 2/1989 |
| CN | 1031489 | | 3/1989 |
| CN | 1030326 | | 11/1995 |
| CN | 1030376 | | 11/1995 |
| CN | 1048427 | | 1/2000 |
| CN | 1240813 | | 1/2000 |
| CN | 1247885 | | 3/2000 |
| CN | 1056869 | | 9/2000 |
| CN | 1060204 | | 1/2001 |
| CN | 1060755 | | 1/2001 |
| CN | 1069682 | | 8/2001 |
| CN | 1313268 | | 9/2001 |
| CN | 1353012 | | 6/2002 |
| JP | 6127936 | | 5/1994 |

OTHER PUBLICATIONS

Translation of CN 1031029, published Feb. 1989.*
English Language Abstract of CN 1031029. no date.
English Language Abstract of CN 1048427, no date.
English Language Abstract of CN86101990, no date.
English Language Abstract of CN1030376, no date.
English Language Abstract of CN 1060204, no date.
English Language Abstract of CN 1031489, no date.
English Language Abstract of CN 1056869, no date.
English Language Abstract of CN 1069682, No date.
English Language Abstract of CN 1060755, no date.
English Language Abstract of CN 1030326, no date.
English Language Abstract of CN13268, no date.
English Language Abstract of CN 1240813, no date.
English Language Abstract of CN 1247885, no date.
English Language Abstract of CN 6127396, no date.
English Language Abstract of JP Appln. No. 6–127936. 1994.

* cited by examiner

*Primary Examiner*—Christina Johnson
(74) *Attorney, Agent, or Firm*—Greenblum & Bernstein, P.L.C.

(57) ABSTRACT

The present invention relates to a cracking catalyst comprising layered clays and a process for cracking hydrocarbon oils using said catalyst. Said catalyst is prepared by the process comprising the following steps: mixing and slurrying an expandable clay, a modifier component, pseudoboehmite and water for 0.1–10 h to obtain a slurry, aging the slurry at 50–85° C. for 0.1–10 h, then drying and forming the slurry to obtain a formed material, water washing and aging the solid, and finally drying and calcining the solid, and said modifier being one or more selected from the group consisting of hydroxyl polymers of silicon, aluminum, zirconium or titanium, and substances comprising one or more of said hydroxyl polymers. Said process for cracking hydrocarbon oils comprises contacting a hydrocarbon oil with a catalyst under the cracking conditions, said catalyst being the aforesaid cracking catalyst comprising layered clays or a mixture of at least 1% by weight of said cracking catalyst comprising layered clays and a prior cracking catalyst. The catalyst according to the present invention has an improved ability to convert heavy oils. The process according to the present invention for cracking hydrocarbon oils has higher conversion of hydrocarbon oils and higher yield of light oils.

28 Claims, No Drawings

CRACKING CATALYST COMPRISING LAYERED CLAYS AND A PROCESS FOR CRACKING HYDROCARBON OILS USING THE SAME

FIELD OF THE INVENTION

The present invention relates to a cracking catalyst and a process using the same for cracking hydrocarbon oils. In particular, it relates to a cracking catalyst comprising layered clays and a process using the same for cracking hydrocarbon oils.

BACKGROUND TECHNIQUES

The situation that crude oil becomes heavier is more and more severe in recent years, and the fractions with boiling points higher than 400° C. are hard to enter the pores of zeolites in crude oil. Therefore the ability of the prior zeolite-comprising catalysts to crack heavy oils cannot meet the requirements for raising the economical benefits. It has been found that the addition of layered clays to cracking catalysts can enhance the ability of cracking catalysts to crack heavy oils.

CN1031029A discloses a layer-pillared clay molecular sieve catalytic cracking catalyst, which consists of active components, support components, and binder components. The active component is a layer-pillared molecular sieve with a regular interlayer mineral structure including rectorite, or a mixture of this clay molecular sieve with other molecular sieves such as faujasite, faujasite treated by chemical and/or stabilizing treatment, or ZSM-5 series molecular sieves which accounts for 1–100%, preferably 40–60% by weight of the catalyst. The support component includes various natural clays including kaolin clay and rectorite, or various synthetic refractory oxide supports including amorphous silica-alumina, alumina, silica, or mixtures thereof which accounts for 0–99%, preferably 30–40% by weight of the catalyst. Preferably, the support component is halloysite. The binder component includes alumina sol, silica sol, silica-alumina sol and the mixtures thereof which accounts for 0–99%, preferably 10–30% by weight of the catalyst, preferably alumina sol or silica sol.

CN1031029A discloses a process for preparing the catalyst which comprises (1) mixing and forming a clay having a regular interlayer structure or a mixture of the clay and other molecular sieves, which serves as a precursor of the active component with a support component and a binder component in a ratio of 1–100:0–99:0–99 on a calcination basis; (2) formulating an inorganic metal hydroxyl polymer to a dilute aqueous solution with a concentration lower than 100 mmol Al/l and regulating the pH of the solution with $NH_4OH$ to pH 4–6 to yield a cross-linking solution; (3) adding the formed material obtained in (1) to the cross-linking solution obtained in (2) in an amount of 1.5–5.0 mmol Al per gram of the regular interlayer mineral clay in the active component and conducting the cross-linking reaction at the room temperature while maintaining the pH of the slurry at 4–6 with $NH_4OH$; and (4) aging the slurry at 70–75° C. with stirring for 1–5 h while maintaining the pH of the slurry at 4–6, and then filtering, washing, drying, and calcining the resultant.

CN1048427C discloses a layer-pillared molecular sieve catalyst having a high olefin yield and comprising the following composition: (1) 10–50% by weight of a layer-pillared molecular sieve; (2) 4–30% by weight of a ZSM-5 zeolite modified with an element selected from the group consisting of H, Mg, RE, Zn, and P; (3) 0–15% by weight of one zeolite selected from the group consisting of β-zeolite, mordenite and ultrastable Y-zeolite; (4) 10–70% by weight of natural clays; and (5) 10–35% by weight of inorganic oxides. Said natural clay is selected from kaolin clay and halloysite. Said inorganic oxide is one or more selected from alumina, silica, and amorphous silica-alumina, the precursors of which are pseudo-boehmite, silica sol, alumina sol, and silica-alumina sol or gel thereof.

CN1048427C discloses a catalyst which can be prepared by two processes, i.e. pre-cross-linking process and post cross-linking process.

The pre-cross-linking process comprises (1) mixing and slurrying the natural clay and deionized water, acidifying the slurry by adding concentrated hydrochloric acid and stirring for 0.5–1 h, then adding the inorganic oxide or its precursor and stirring for additional 0.5–1 h to yield a support slurry comprising 10–40% by weight of solid, and (2) adding the layer-pillared molecular sieve prepared by the process of CN 86101990A and other molecular sieves, stirring the slurry for 0.5–1 h, and then forming and drying the resultant.

The post cross-linking process comprises (1) mixing, slurrying and forming the interlayer mineral structure clay as the precursor of the layer-pillared molecular sieve such as rectorite, corrensite, mica-montmorillonite, mica-vermiculite, or monolayer mineral structure clays such as montmorillonite, bentonite, hectorite, beidellite, vermiculite, the mixtures thereof with other molecular sieves and natural clays, and inorganic oxides to obtain a formed material; (2) formulating an inorganic metal hydroxyl polymer to a cross-linking solution with a concentration less than 100 mmol Al/l and regulating the pH of the solution to pH 4–6 with $NH_4OH$; (3) adding the formed material to the cross-linking solution comprising cross-linking agent in an amount of 1.5–5.0 mmol Al per gram of rectorite, and reacting the mixture at room temperature for 5–15 min, and maintaining the pH of the slurry at pH 4–6 with $NH_4OH$; (4) stirring and aging at 70–75° C. for 1–5 h while maintaining the pH at 4–6; (5) filtering, washing, and drying the resultant from step (4); (6) calcining the resultant from step (5) at 550–750° C. for 0.5–4 h.

CN1030376C discloses a layer-pillared clay microspherical catalyst, which has a stable macroporous layer-pillared structure and highly regularly interstratified crystalline structure, a bottom spacing $d_{001}$ of up to $65\times10^{-10}$ m, an interlayer spacing of up to $45\times10^{-10}$ m, and an intensity of the $d_{001}$ diffraction peak of up to more than 10000. The catalyst is prepared by the cross-linking reacting, forming, aging, washing, drying and calcining the mixture of the guide agent, cross-binder (in term of oxide), clay, and auxiliary component in a weight ratio of 0.1–98.0:1–98.9:1–98.9:0–97. Said guide agent is polyvinyl alcohol or an organic polymer having the formula of $(—C{=}CHOH—)_n$; the cross-binder is one or more selected from the group consisting of alumina sol, silica-alumina sol, silica sol modified with polyvinyl alcohol including polymerized aluminum hydroxychloride, and zirconium sol including polymerized zirconium hydroxychloride, and copolymers or mixtures thereof; the clay is selected from the group consisting of various natural or synthetic expandable regular interlayer clay minerals including rectorite, smectite or monolayer clay minerals, and mixtures thereof; and the auxiliary component is one or more selected from the group consisting of kaolin family clays, inorganic oxide support components, sol binder components comprising aluminum, silicon, zirconium, and faujasite, ZSM-5 series zeolite active components.

CN1060204C discloses a layer-pillared clay microspherical catalyst for cracking heavy oils and the preparation process thereof, which catalyst consists of 20–90% by weight of a layer-pillared clay, 10–40% by weight of a binder with alumina as a major chemical component, 0–40% by weight of Y-zeolite, and 0–70% by weight of a kaolin family clay. Said layer-pillared clay is an expandable clay cross-linked by aluminum interlayer pillar. The precursor of said aluminum interlayer pillar is alumina sol modified with one selected from the group consisting of pseudo-boehmite, aluminum metal, $NH_4OH$, NaOH, polyvinyl alcohol, fluorocarbon surfactant, or $[Al_{13}O_4(OH)_{24}(H_2O)_{12}]^{+7}$-containing poly hydroxyl aluminum complex. Said binder is formed by drying and calcining the precursor thereof, which may be mixtures of alumina sol and alumina gel obtained by directly peptizing pseudo-boehmite or aluminum metal by the acid obtained via hydrolysis of alumina sol after mixing and heating alumina sol and pseudo-boehmite or aluminum metal, or may be colloidal substances formed by peptizing pseudo-boehmite by adding an inorganic acid, or may also be alumina sol and/or alumina gel comprising polyvinyl alcohol or fluorocarbon surfactant or silica-alumina sol.

It can be seen that a cross-linking step for cross-linking the layered clay by a cross-linking agent to convert the layered clay to layer-pillared molecular sieve is necessary in order to obtain the cracking catalyst comprising layer-pillared molecular sieve in the prior art.

Said cross-linking agent may be an inorganic metal hydroxyl polymer (see CN1031029A, CN1048427C). When an inorganic metal hydroxyl polymer is used as a cross-linking agent, the dilute aqueous solution thereof, e.g. a dilute solution with a concentration below 100 mmol Al/l is used and the use amount is more than 20 times of that of the layered clay, which results in a considerable amount of waste liquid to be treated. Besides, when such dilute aqueous solution is used as a cross-linking agent, the pH of the slurry has to be strictly controlled between 4–6, which undoubtedly increases the difficulty in the preparation of the catalyst comprising layer-pillared molecular sieve and in the large-scale industrial production of such a catalyst. Also, this process is too complicated.

Said cross-linking agent may also be alumna sol, silica-alumina sol, or silica sol modified with polyvinyl alcohol and fluorocarbon surfactant (see CN1030376C, CN1060204C). This process does not need a considerable amount of dilute aqueous solution; however, due to the foamability and adhesivity of the polyvinyl alcohol and surfactant used, the foamability renders the dried and formed catalyst having a loose texture, low bulk density, and poor strength on the one hand, and on the other hand, the adhesivity renders the catalyst bond to the inner of the drier such as the wall of the drying tower during drying, especially during spray drying. As a result, a thick solid layer formed in the drying tower is hard to be removed and the yield of the catalyst is lowered. Another disadvantage of the process is that it is too complicated to be industrialized.

Said cross-linking agent may also be a colloidal substance formed by peptizing pseudo-boehmite with an acid (see CN1060204C). This colloidal substance needs to be prepared solely, for example, heating the slurry of alumina sol and pseudo-boehmite to 90–100° C., and the colloidal substance obtained by peptizing the pseudo-boehmite with the acid available from the pyrohydrolysis of alumina sol can act both as a cross-linking agent and as a binder. However, such process is also too complicated.

Furthermore, it is a common disadvantage of the prior catalysts that the ability for cracking heavy oils is not strong enough, so that the conversion of hydrocarbon oils and the yield of light oils are not high enough.

SUMMARY OF THE INVENTION

The object of the present invention is to provide a layered clay-comprising catalyst having a stronger ability to crack heavy oils, and another object of the present invention is to provide a process for cracking hydrocarbon oils with a higher conversion of hydrocarbon oils and a higher yield of light oils.

The catalyst according to the present invention is prepared by a process comprising the following steps:

(1) mixing and slurrying an expandable clay, a modifier, pseudo-boehmite, and water for 0.1–10 h to obtain a slurry comprising 10–40% by weight of solid, wherein various substances are added such that the resultant catalyst contains 1–98.8% by weight of the expandable clay, 0.1–50% by weight of the oxide derived from the modifier components, 0.1–70% by weight of the alumina derived from pseudo-boehmite based on the total weight of the catalyst, said modifier component is one or more selected from the group consisting of hydroxyl polymers of silicon, aluminum, zirconium, or titanium, and substances comprising one or more said hydroxyl polymers;

(2) heating the slurry obtained in (1) to 50–85° C. and aging the slurry at this temperature for 0.1–10 h;

(3) drying and forming the slurry obtained in (2);

(4) water washing and aging the formed material obtained in (3) and filtering; and (5) dying and calcining the solid obtained in (4).

The process according to the present invention comprises contacting hydrocarbon oils with a catalyst under the cracking conditions, wherein said catalyst is a cracking catalyst comprising a layered clay, or a mixture of at least 1% by weight, based on the total weight of the mixture, of said cracking catalyst comprising a layered clay and prior cracking catalysts, and said cracking catalysts comprising a layered clay is a catalyst prepared by the above-mentioned preparation process according to the present invention.

The catalyst according to the present invention has a stronger ability to convert heavy oils than the catalysts disclosed in the prior art, and the process according to the present invention has advantages such as high conversions of hydrocarbon oils and high yields of light oils. For example, when the process for cracking hydrocarbon oils with the catalyst according to the present invention (i.e. the process according to the present invention for cracking hydrocarbon oils) is used to catalytically crack hydrocarbon oils comprising heavy oils, higher conversions of hydrocarbon oils and higher yields of light oils can be achieved.

In accordance with one embodiment of the present invention, a VGO with a boiling range of 227–475° C. was catalytically cracked under conditions of a reaction temperature of 482° C., a weight hourly space velocity of 16 $h^{-1}$, and a catalyst/oil weight ratio of 3.0, using the process according to the present invention and a catalyst comprising 50.0% by weight of rectorite, 8.8% by weight of the alumina derived from a modifier—alumina sol, 20.0% by weight of the alumina derived from pseudo-boehmite, 11.2% by weight of kaolin clay, and 10.0% by weight of RE ultrastable Y-zeolite. As a result, the conversion was 74.1% by weight, and the yield of light oils was 78.6% by weight.

When the catalysts prepared using the two processes disclosed in CN1048427C with similar compositions were used under the same operation conditions, the conversions were only 72.1% and 71.3% by weight respectively, and the yields of light oils were only 77.4% and 77.6% by weight respectively.

When the catalyst prepared by the process disclosed in CN1030376C, i.e. using alumina sol modified with polyvinyl alcohol as a cross-binder (the contents of various components were similar in term of rectorite), the conversion was only 73.2% by weight, and the yield of light oils was only 77.9% by weight.

When the catalyst with similar composition (in term of rectorite) prepared by the process of CN1060204C, i.e. using alumina sol modified with pseudo-boehmite as a cross-binder, the conversion was only 72.9% by weight, and the yield of light oils was only 75.6% by weight.

In accordance with another embodiment of the present invention, the same feedstock was catalytically cracked under the same operation conditions and using the process according to the present invention, and a catalyst comprising 47.0% by weight of RE-type rectorite, 8.0% by weight of the alumina derived from modifier—alumina sol, 25.0% by weight of the alumina derived from pseudo-boehmite, and 20.0% by weight of RE ultrastable Y-zeolite. As a result, the conversion was up to 82.1% by weight, and the yield of light oils was up to 79.0% by weight; when an industrial catalyst under the trademark of DVR-1 comprising RE ultrastable Y-zeolite was used, the conversion was only 70.9% by weight, and the yield of light oils was only 71.7% by weight.

The process according to the present invention not only has the advantages of high conversions of hydrocarbon oils and high yields of light oils, but also can produce more olefins by varying the species and amounts of the zeolites in said cracking catalyst comprising layered clays. Furthermore, the yield of olefins is higher than that obtained by the prior processes using the prior catalysts. For example, a VGO with a boiling range of 227–475° C. was catalytically cracked under conditions of a reaction temperature of 520° C., a weight hourly space velocity of 16 $h^{-1}$, and a catalyst/oil weight ratio of 3.0, by using the process according to the present invention and a catalyst comprising 37.0% by weight of RE-type rectorite, 25.0% by weight of the alumina derived from pseudo-boehmite, 8.0% by weight of the alumina derived from the modifier—alumina sol, 10.0% by weight of kaolin clay, 5.0% by weight of ultrastable Y-zeolite, and 15.0% by weight of ZRP-1 zeolite. As a result, the conversion was 74.7% by weight, and the yield of $C_2$–$C_4$ olefins was 34.18% by weight, while using a prior industrial catalyst with high olefin productivity under the same conditions, the conversion was only 68.4% by weight, and the yield of $C_2$–$C_4$ olefins was only 31.68%.

Furthermore, compared to the prior art, the catalyst according to the present invention is easy to industrialize, and the costs of both the catalyst and the process for cracking hydrocarbon oils according to the present invention are low. In the prior art, all processes for preparing the catalysts comprising layer-pillared molecular sieves comprise a cross-linking step and a step for preparing the cross-linking agent, or a step for preparing the cross-binder. When the cross-linking reaction is conducted using a dilute aqueous solution comprising hydroxyl polymers, the concentration of the dilute aqueous solution is very low, and the volume thereof is very big. For example, the concentration of the cross-linking agent, dilute aqueous solution of aluminum hydroxychloride, is 100 mmol Al/l, and therefore a considerable amount of the dilute aqueous solution is needed to complete the cross-linking reaction. In addition, the pH of the slurry must be accurately controlled at 4–6 in the cross-linking and aging step. Therefore, the process is not only complicated but also hard to be controlled and operated. Meanwhile, a large amount of hydroxyl polymers is wasted, and the amount of waste liquid to be treated is also very large. With regard to the process wherein the cross-linking agent is prepared in advance, the process is complicated, and heating is needed, resulting a higher energy consumption and a higher production cost of the catalyst. The process according to the present invention has greatly improved the processes for preparing the catalyst in the prior art by omitting the cross-linking step and the step for preparing the cross-linking agent or cross-binder, and therefore not only greatly simplifies the process for preparing the catalyst and maks it easier to industrialize, but also greatly decreases the amount of the hydroxyl polymer, the amount of the waste liquid to be treated, and the energy consumption, and greatly lowers the production cost of the catalyst and the cost of the process for cracking hydrocarbon oils according to the present invention.

MODE FOR CARRYING OUT THE INVENTION

In the process for preparing the catalyst according to the present invention, a kaolin family clay may also be added to said slurry. Said kaolin family clay may be added at any time before drying and forming of the slurry in step (3), preferably before step (2), that is, heating and aging of the slurry. The amount of the kaolin family clay is selected such that the solid content in the slurry is 10–40% by weight and the resultant catalyst contains 0–70%, preferably 0–50% by weight of the kaolin family clay.

Said kaolin family clay is one or more selected from the group consisting of kaolin clay, halloysite, and kaolin clay and halloysite modified by the prior methods, preferably kaolin clay and/or halloysite.

The process for preparing the catalyst according to the present invention may further comprises adding a zeolite to said slurry, and said zeolite may be added at any time before drying and forming of the slurry in step (3), preferably after step (2), that is, after heating and aging and before drying and forming of the slurry, the amount of the zeolite is selected such that the slurry contains 10–40% by weight of solid and the resultant catalyst contains 0–50%, preferably 0–40% by weight of the zeolite.

Said zeolite is one or more selected from the group consisting of macroporous and mesoporous zeolites commonly used as the active component of the cracking catalyst such as faujasite, β-zeolite, ZSM series zeolites, and mordenite, preferably Y-zeolite, Y-zeolite comprising rare earth, and zeolites with the ZSM-5 zeolite structure, and more preferably ultrastable Y-zeolite, ultrastable Y-zeolite comprising rare earth, and zeolites with the ZSM-5 zeolite structure.

The amounts of the expandable clay, modifier component, pseudo-boehmite, and water are added such that the obtained slurry contains 10–40%, preferably 15–35% by weight of solid, and the resultant catalyst contains 1–98.8%, preferably 20–70% by weight of the expandable clay, 0.1–50%, preferably 1–40% by weight of the oxide derived from the modifier component, and 0.1–70%, preferably 3–40% by weight of the alumina derived from pseudo-boehmite.

Said time for stirring the slurry is 0.1–10 h, preferably 0.5–5 h.

Said expandable clay is one or more selected from the group consisting of natural or synthetic expandable monolayer mineral structure clays and natural or synthetic regular interlayer mineral structure clays. The expandable monolayer mineral structure clays include montmorillonite, bentonite, hectorite, beidellite, vermiculite, etc. The regular interlayer mineral structure clay includes (1) mica-smectite, such as rectorite, tarasovite, mica-montmorillonite, (2) illite-smectite, (3) glauconite-smectite such as glauconite-montmorillonite, (4) chlorite-smectite such as tosudite, corrensite, chlorite-montmorillonite, (5) mica-vermiculite, and (6) kaolinite-smectite such as kaolinite-montmorillonite.

Said expandable clay is preferably one or more of clays with regular interlayer mineral structure, more preferably one or more of rectorite, mica-montmorillonite, glauconite-montmorillonite, chlorite-montmorillonite, mica-vermiculite, and kaolinite-montmorillonite, especially rectorite.

Said expandable clay may be one or more of Ca-type expandable clays, or Na-, RE-, H-type expandable clays obtained by the ion-exchanging of Ca-type, preferably one or more of Na-, RE-, H-type expandable clays such as Na-, RE-, and/or H-type rectorite.

Said modifier component is one or more selected from hydroxyl polymers of silica, aluminum, zirconium, or titanium, and one or more of the substances comprising said hydroxyl polymers. Said one or more substances comprising said hydroxyl polymers may be, e.g., alumina sol, silica sol, and/or silica-alumina sol.

In the present invention, said pseudo-boehmite plays a role of a binder to make the catalyst have a better strength and bulk density on the one hand, and can prevent the dried and formed catalyst from collapsing caused by dissolving of the hydroxyl polymers such as alumina sol etc in the catalyst into water during water washing and aging on the other hand. Since the hydroxyl polymer and the substance comprising hydroxyl polymers such as alumina sol are reversibly dissolved in water even after being dryed, the dried and formed catalyst would collapse and its shape would be destroyed when it meets water. The presence of pseudo-boehmite can prevent the shape of dried and formed catalyst from being damaged during water washing and aging.

Said aging temperature in step (2) is 50–85° C., preferably 50–75° C., and the aging time is 0.1–10 h, preferably 0.5–5 h.

Said method and condition for drying and forming the slurry are well known to the skilled in the art; e.g. either a common drying method or a spray drying method can be used to form the slurry into microspherical catalyst. The drying temperature may be 100–400° C., preferably 120–350° C.

Said method for water washing and aging the slurry are well known to the skilled in the art. Said water washing is to wash the obtained solid with deionized water, and the amount of deionized water is 5–1000 times, preferably 15–60 times of the solid weight. The aging is to heat the mixture of said solid and deionized water at 20–90° C., preferably 40–75° C. for 0.1–10 h, preferably 0.5–5 h.

Said conditions for drying and calcining after water washing and aging are also well known to the skilled in the art. Said drying temperature is generally 100–400° C., preferably 120–350° C. The calcining temperature is 450–750° C., preferably 500–700° C., and the calcining time is 0.5–5 h, preferably 1–3 h.

The catalyst according to the present invention may serve as a main catalyst to catalytically crack hydrocarbon feedstocks alone, especially hydrocarbon feedstocks comprising heavy oils. Besides, as a co-catalyst, the catalyst according to the present invention may also be mixed with other cracking catalysts to catalytically crack hydrocarbon feedstocks, especially hydrocarbon feedstocks comprising heavy oils. When serving as a co-catalyst, the content of the catalyst according to the present invention is at least 1% by weight of the total weight of the catalyst, preferably at least 5%, more preferably at least 10%.

According to the process for cracking hydrocarbon oils according to the present invention, said cracking conditions are well known to the skilled in the art. Said cracking conditions comprises: a reaction temperature of 450–700° C., preferably 460–680° C., a weight hourly space velocity of 0.2–20 $h^{-1}$, preferably 1–10 $h^{-1}$, and a catalyst/oil weight ratio of 2–12, preferably 3–10.

Said hydrocarbon oil is one or more selected from the group consisting of VGO, atmospheric residue, hydrogenation tail oil, VGO blended with vacuum residue, VGO blended with atmospheric residue, VGO blended with coker gas oil, VGO blended with hydrogenation tall oil, and VGO blended with deasphalted oil, preferably atmospheric residue, VGO blended with vacuum residue, VGO blended with atmospheric residue, VGO blended with coker gas oil, VGO blended with hydrogenation tail oil, and VGO blended with deasphalted oil.

Said catalyst may be used alone or in combination with the mixture of cracking catalyst comprising layered clays and a prior catalyst, which mixture contains at least 1% by weight of said cracking catalyst comprising layered clays, preferably at least 5%, more preferably at least 10%.

Said prior catalyst refers to the disclosed various types of cracking catalysts, such as the cracking catalysts comprising one or more zeolites of faujasite, β-zeolite, ZSM series zeolite, and mordenite, preferably the catalysts comprising one or more of Y-zeolite, RE Y-zeolite, and the zeolites having the ZSM-5 zeolite structure, and more preferably the catalysts comprising one or more of ultrastable Y-zeolite, RE ultrastable Y-zeolite, and the zeolites having the ZSM-5 zeolite structure.

The following examples will further illustrate the present invention.

EXAMPLE 1

The present example illustrates the catalyst according to the present invention and the preparation process thereof.

19.3 kg of deionized water, 4.2 kg of alumina sol (available from the Catalyst Plant of Qilu Petrochemical Co., comprising 21.2% by weight of $Al_2O_3$), 8.0 kg of RE-type rectorite (comprising 62.8% by weight of solid, 2.07% by weight of $RE_2O_3$, wherein $La_2O_3$ accounts for 53.2% of the $RE_2O_3$ weight, $Ce_2O_3$ 13.0%, other $RE_2O_3$ 33.8%, the preparation process will be described below), 1.5 kg of kaolin clay (comprising 72.7% by weight of solid, available from Suzhou Kaolin Co.), and 6.1 kg of pseudo-boehmite (comprising 33% by weight of solid, available from Shandong Aluminum Plant) were mixed, slurried, and stirred for 0.5 h. The resultant slurry was heated to 65° C., aged at this temperature for 1 h, and cooled to the room temperature. 1.03 kg of ultrastable Y-zeolite (unit cell size 24.42 Å, solid content 96.95% by weight, available from the Catalyst Plant of Qilu Petrochemical Co.) was added and the mixture was stirred to make it uniform, and yield a slurry comprising 25% by weight of solid. The resultant slurry was subjected to spray drying at 300° C. to obtain microspherical solid.

The resultant microsphere was mixed with deionized water of pH=5 in an amount of 20 times of the microsphere weight. The resultant slurry was aged at 70° C. for 2 h, then filtered, washed with deionized water (20 times of the microsphere weight), dried at 120° C., and calcined at 650° C. for 2 h to obtain catalyst $C_1$ used in the present invention. Catalyst $C_1$ had the following composition based on the total amount of the catalyst: 50.0% by weight of RE-type rectorite, 20.0% by weight of the alumina derived from pseudo-boehmite, 8.8% by weight of the alumina derived from the modifier—alumina sol, 11.2% by weight of kaolin clay, 10.0% by weight of ultrastable Y-zeolite. The composition of the catalyst microsphere was obtained from calculation. The attrition resistant index of the microspherical catalyst $C_1$ was 1.3%/h, and the average bulk density was 0.91 g/ml. The attrition resistant index was determined by the straight tube method.

The process for preparing the RE-type rectorite was as follows: Ca-type rectorite, $RECl_3$ (the content of $RE_2O_3$ was 48% by weight, wherein $La_2O_3$ accounts for 53.2% of the $RE_2O_3$ weight, $Ce_2O_3$ 13.0%, and other $RE_2O_3$ 33.8%, available from Baotou Rare Earth Plant), and deionized water in a weight ratio of 1:0.05:10 were mixed and ion-exchanged at the room temperature for 1 h with stirring. The resultant slurry was filtered, and the solid was eluted with the same volume of deionized water to convert Ca-type rectorite to RE-type rectorite. The Ca-rectorite was available from Hubei Geological Research Institute.

COMPARATIVE EXAMPLE 1

The present comparative example illustrates a reference catalyst and the preparation process thereof.

The catalyst was prepared according to the process of CN1048427C.

To 21.9 kg of deionized water, 8.0 kg of the RE-type rectorite described in Example 1, 1.5 kg of kaolin clay, and 7.6 kg of pseudo-boehmite were sequentially added. The mixture was stirred for 1 h, then heated to 65° C., aged at this temperature for 1 h, and cooled to the room temperature. 1.03 kg of the ultrastable Y-zeolite described in Example 1 was added, and the mixture is stirred to make it uniform to yield a slurry comprising 25% by weight of solid. The resultant slurry was spray dried at 300° C. to yield microspherical solid. The microspherical solid was added to a dilute solution of polymerized aluminum hydroxychloride with a concentration of 100 mmol/l (the preparation process will be described below) in a ratio of 5 mmol Al per g of rectorite clay, and the solution was stirred at the room temperature for 10 min to conduct reaction, during which the pH was maintained at 5–6 with ammonia water. After reaction, the pH of the slurry was still maintained at 5–6, and the slurry was aged at 70° C. for 3 h with stirring, then filtered, washed with deionized water (20 times of the weight of the solid particles), dried at 120° C., and calcined at 650° C. for 2 h to yield Reference Catalyst $B_1$. Based on the total amount of the catalyst, the composition of Reference Catalyst $B_1$ was 50.0% by weight of RE-type rectorite, 25.0% by weight of the alumina derived from pseudo-boehmite, 3.8% by weight of the alumina derived from the polymerized aluminum hydroxychloride, 11.2% by weight of kaolin clay, and 10.0% by weight of ultrastable Y-zeolite.

The process for preparing the dilute solution of polymerized aluminum hydroxychloride was as follows:

1 mol of NaOH reacts with 1 mol of $AlCl_3$ to yield polymerized aluminum hydroxychloride with a concentration of 222 mmol Al/l, which was diluted with deionized water to 100 mmol Al/l and regulated with 3% ammonia water to pH 5–6, heated to 70° C., regulated with 3% ammonia water to pH 5–6, and aged for 3 h with stirring to yield the dilute solution of polymerized aluminum hydroxychloride.

COMPARATIVE EXAMPLE 2

The present comparative example illustrates a reference catalyst and the preparation process thereof.

The catalyst was prepared according to the process disclosed in CN1048427C.

To 24.1 kg of deionized water, 1.5 kg of kaolin clay and 7.6 kg of pseudo-boehmite described in Example 1 were sequentially added. The mixture was stirred for 1 h, then heated to 65° C., aged at this temperature for 1 h, and cooled to the room temperature. 5.8 kg of layer-pillared rectorite molecular sieve (solid content 92.5% by weight, the preparation process will be described below) and 1.03 kg of the ultrastable Y-zeolite used in Example 1 were added, and the mixture is stirred to make it uniform to yield a slurry comprising 25% by weight of solid. The resultant slurry was spray dried at 300° C., and calcined at 650° C. for 2 h to yield Reference Catalyst $B_2$. Based on the total amount of the catalyst, the composition of Reference Catalyst $B_2$ was 50.0% by weight of RE-type rectorite, 25.0% by weight of the alumina derived from pseudo-boehmite, 3.8% by weight of the alumina derived from the polymerized aluminum hydroxychloride, 11.2% by weight of kaolin clay, and 10.0% by weight of the ultrastable Y-zeolite. The content of the RE-type rectorite was calculated based on the amount of the RE-type rectorite used in the preparation process.

The process for preparing the layer-pillared molecular sieve was as follows:

The RE-type rectorite was added to a dilute solution of polymerized aluminum hydroxychloride with a concentration of 100 mmol/l and a pH of 5–6 in a ratio of 5 mmol Al per gram of rectorite clay, and the solution was stirred at the room temperature for 10 min to conduct reaction, during which the pH was maintained at 5–6 with 3% ammonia water. After reaction, the pH of the slurry was still maintained at 5–6, and the slurry was aged at 70° C. for 3 h with stirring, and then filtered. The filtered cake was washed with deionized water until it was free of $Cl^-$, then dried at 110° C. for 2 h, and calcined at 650° C. for 2 h to yield the layer-pillared rectorite molecular sieve.

COMPARATIVE EXAMPLE 3

The present comparative example illustrates a reference catalyst and the preparation process thereof.

The catalyst was prepared according to the process disclosed in CN1030376C.

13.6 kg of alumina sol (same as that used in Example 1) was diluted with water to an $Al_2O_3$ content of 5.44% by weight, then 1.5 kg of 4% by weight of aqueous solution of polyvinyl alcohol was added. The mixture was aged at 70° C. for 3 h, cooled down to the room temperature overnight. 8.0 kg of the RE-type rectorite described in Example 1 was added, stirred for 1 h, then 1.5 kg of the kaolin clay described in Example 1 was added, stirred for 1 h, then 1.03 kg of the ultrastable Y-zeolite described in Example 1 was added again, stirred for 0.5 h, then spray dried, water washed and aged, dried and calcined according to the procedure of Example 1 to yield Reference Catalyst $B_3$. Based on the total amount of the catalyst, Reference Catalyst $B_3$ has the following composition: 50.0% by weight of RE-type rectorite, 28.8% by weight of the alumina derived from alumina sol, 11.2% by weight of kaolin clay, 10.0% by weight of ultrastable Y-zeolite. The attrition resistant index of the microspherical Catalyst $B_3$ was >10% $h^{-1}$, and the average bulk density was 0.58 g/ml.

COMPARATIVE EXAMPLE 4

The present comparative example illustrates a reference catalyst and the preparation process thereof.

The catalyst was prepared according to the process disclosed in CN1060204C.

9.3 kg of alumina sol (same as that used in Example 1), 2.7 kg of pseudo-boehmite (identical with Example 1) and 17.5 kg of deionized water were uniformly mixed. The resultant slurry was heated to 95° C. and kept for 0.5 h, then cooled down to 70° C. and maintained for additional 2.5 h, and then cooled down to the room temperature. 8.0 kg of the RE-type rectorite described in Example 1 was added and the cross-linking reaction was conducted at the room temperature for 1 h. 1.5 kg of the kaolin clay and 1.03 kg of ultrastable Y-zeolite described in Example 1 were added and the mixture is stirred uniformly to yield a slurry comprising 25% by weight of solid. The slurry was then spray dried, water washed, dried and calcined according to the procedure of Example 1 to yield Reference Catalyst $B_4$. Based on the total amount of the catalyst, Reference Catalyst $B_4$ has the following composition: 50.0% by weight of RE-type rectorite, 9.0% by weight of the alumina derived from pseudo-boehmite, 19.8% by weight of the alumina derived from alumina sol, 11.2% by weight of kaolin clay, 10.0% by weight of ultrastable Y-zeolite.

COMPARATIVE EXAMPLE 5

The present comparative example illustrates a reference catalyst.

Reference catalyst $B_5$ described in this comparative example is an industrial catalyst under a trademark of ZCM-7 available from the Catalyst Plant of Qilu Petrochemical Co., and the major active component thereof is ultrastable Y-zeolite.

EXAMPLE 2

The present example illustrates a catalyst according to the present invention and the preparation process thereof.

Catalyst $C_2$ according to the present invention was prepared according to the process of Example 1, except that kaolin clay was not added, the amount of deionized water was 19.3 kg, the amount of alumina sol was 3.8 kg, the amount of RE-type rectorite was 7.3 kg, the amount of pseudo-boehmite was 7.5 kg, the ultrastable Y-zeolite was replaced with RE ultrastable Y-zeolite (unit cell size was 24.53 Å, solid content was 94.35% by weight, based on dry zeolite, $RE_2O_3$ content was 2.1% by weight, wherein $La_2O_3$ content was 53.2% of the $RE_2O_3$ weight, $Ce_2O_3$ content 13.0%, and other $RE_2O_3$ 33.8%, available from the Catalyst Plant of Qilu Petrochemical Co.), the amount of the RE ultrastable Y-zeolite was 2.12 kg. Based on the total weight of the catalyst, Catalyst $C_2$ has the following composition: 47.0% by weight of RE-type rectorite, 25.0% by weight of the alumina derived from pseudo-boehmite, 8.0% by weight of the alumina derived from the modifier—alumina sol, and 20.0% by weight of the RE-containing ultrastable Y-zeolite.

EXAMPLE 3

The present example illustrates a catalyst according to the present invention and the preparation process thereof.

Catalyst $C_3$ according to the present invention was prepared according to the process of Example 1, except that the amount of deionized water was 18.4 kg, the amount of alumina sol was 3.8 kg, the amount of RE-type rectorite was 5.8 kg, the amount of kaolin clay was 1.4 kg, said ultrastable Y-zeolite was replaced with a mixture of 0.5 kg of ultrastable Y-zeolite (unit cell size was 24.42 Å, available from the Catalyst Plant of Qilu Petrochemical Co.) and 1.7 kg of zeolite with the ZSM-5 structure (trademark was ZRP-1, available from the Catalyst Plant of Qilu Petrochemical Co., solid content was 91.3% by weight, $SiO_2/Al_2O_3$ mol ratio was 15). Based on the total weight the catalyst, Catalyst $C_3$ has the following composition: 37.0% by weight of RE-type rectorite, 25.0% by weight of the alumina derived from pseudo-boehmite, 8.0% by weight of the alumina derived from the modifier—alumina sol, 10.0% by weight of kaolin clay, and 20.0% by weight of the total zeolite, wherein the content of the ultrastable Y-zeolite was 5.0% and the content of the ZRP-1 zeolite was 15.0% by weight.

EXAMPLE 4

The present example illustrates a catalyst according to the present invention and the preparation process thereof.

Catalyst $C_4$ used in the present invention was prepared according to the process of Example 1, except that kaolin clay was not added, the amount of deionized water was 19.6 kg, the amount of alumina sol was 2.3 kg, 1.2 kg acidic silica sol (comprising 25.6% by weight of $SiO_2$, available from Beijing Chemical Plant) was also added, the amount of RE-type rectorite was 7.3 kg, the amount of pseudo-boehmite was 7.5 kg, the stirring time was 2.5 h, the ultrastable Y-zeolite was replaced with the RE ultrastable Y-zeolite described in Example 2, the amount of which was 2.12 kg. Based on the total amount of the catalyst, Catalyst $C_4$ has the following composition: 47.0% by weight of RE-type rectorite, 25.0% by weight of the alumina derived from pseudo-boehmite, 8.0% by weight of alumina and silica formed from the modifiers—alumina sol and acidic silica sol, wherein the alumina derived from the alumina sol amounted 5.0% and the silica formed from the acidic silica sol amounted 3.0%, and 20.0% by weight of RE-comprising ultrastable Y-zeolite.

EXAMPLE 5

The present example illustrates a catalyst according to the present invention and the preparation process thereof.

Catalyst $C_5$ used in the present invention was prepared according to the process of Example 1, except that ultrastable Y-zeolite was not added, the amount of deionized water was 18.0 kg, the amount of alumina sol was 5.0 kg, the amount of kaolin clay was 1.3 kg, the amount of pseudo-boehmite was 6.06 kg, the amount of RE-type rectorite was 9.6 kg, and the starring time was 1.5 h. Based on the total amount of the catalyst, Catalyst $C_5$ has the following composition: 60% by weight of RE-type rectorite, 10.6% by weight of the alumina derived from the modifier—alumina sol, 20% by weight of the alumina derived from pseudo-boehmite, and 9.4% by weight of kaolin clay.

EXAMPLE 6

The present example illustrates a catalyst according to the present invention and the preparation process thereof.

Catalyst $C_6$ used in the present invention was prepared according to the process of Example 1, except that kaolin clay was not added, the RE-type rectorite was replaced by a Na-type rectorite (the preparation process thereof will be described below), the amount of Na-type rectorite (with solid content of 54.0% by weight) was 12.1 kg, the amount of alumina sol was 4.7 kg, the amount of pseudo-boehmite was 7.5 kg, and the amount of deionized water was 15.7 kg. Based on the total amount of the catalyst, Catalyst $C_6$ has the following composition: 65% by weight of Na-type rectorite, 25% by weight of the alumina derived from pseudo-boehmite, and 10% by weight of the alumina derived from alumina sol.

The process for preparing Na-type rectorite was as follows:

14 kg of sodium chloride was dissolved in 500 l of tap water to obtain a solution of sodium chloride. 40 kg (dry basis) of the Ca-type rectorite described in Example 1 was added to the solution of sodium chloride and ion exchange was conducted at the room temperature with stirring for 1 h. Then the resultant slurry was filtered, eluted with a solution of sodium chloride of the same concentration and same amount, and then filtered again to obtain the Na-type rectorite.

EXAMPLE 7

The present example illustrates the process for cracking hydrocarbon oils according to the present invention.

Catalyst $C_1$ was deactivated at 800° C. for 4 h with 100% steam. A VGO with a boiling range of 227–475° C. (the properties thereof are shown in Table 1) was catalytically cracked on a micro-reactor unit with treated Catalyst $C_1$. The operation conditions were a temperature of 482° C., a weight hourly space velocity of 16 $h^{-1}$, and a catalyst/oil weight ratio of 3. The results are shown in Table 2.

In Table 2, conversion=100−yield of light cycle oil−yield of slurry oil. Yield of light oils=yield of gasoline+yield of light cycle oil.

Slurry oil refers the fraction with a boiling range above 330° C., the boiling range of gasoline is $C_5$—204° C., and the boiling range of light cycle oil is 204–330° C.

COMPARATIVE EXAMPLES 6–10

The following comparative examples illustrate the cracking process with the reference catalysts.

The catalysts were deactivated according to the process of Example 7, and the same feedstock was catalytically cracked with the treated catalysts, except that Catalyst $C_1$ was replaced with Reference Catalysts $B_1$–$B_5$. The results are shown in Table 2.

TABLE 1

| Feedstock | VGO |
|---|---|
| Density (20° C.), g · $cm^{-3}$ | 0.8652 |
| Viscosity, $mm^2 \cdot s^{-1}$ | 14.58 |
| Asphaltene, wt % | 0.686 |
| Conradson carbon residue, wt % | 0.04 |
| Distillation, ° C. | |
| IBP | 227 |
| 10% | 289 |
| 50% | 389 |
| 90% | 446 |
| 95% | 458 |
| FBP | 475 |

TABLE 2

| Example No. | Example 7 | Comp. Example 6 | Comp. Example 7 | Comp. Example 8 | Comp. Example 9 | Comp. Example 10 |
|---|---|---|---|---|---|---|
| Catalyst | $C_1$ | $B_1$ | $B_2$ | $B_3$ | $B_4$ | $B_5$ |
| Conversion, wt % | 74.1 | 72.1 | 71.3 | 73.2 | 72.9 | 66.5 |
| Product yields, wt % | | | | | | |
| Gas | 11.6 | 10.4 | 10.2 | 11.5 | 13.0 | 11.5 |
| Coke | 1.5 | 3.2 | 2.8 | 1.7 | 2.4 | 1.1 |
| Gasoline | 61.0 | 58.5 | 58.3 | 60.0 | 57.5 | 53.9 |
| Light cycle oil | 17.6 | 18.9 | 18.3 | 17.9 | 18.1 | 20.2 |
| Slurry | 8.3 | 9.0 | 10.4 | 8.9 | 9.9 | 13.3 |
| Yield of light oils, wt % | 78.6 | 77.4 | 76.6 | 77.9 | 75.6 | 74.1 |

The results in Table 2 show that compared to the processes using the prior catalysts, the cracking process according to the present invention has higher conversion, higher yield of light oils and lower yield of slurry.

EXAMPLE 8

The present example illustrates the cracking process according to the present invention.

The catalyst was deactivated according to the process of Example 7, and the same feedstock was catalytically cracked with the treated catalyst, except that Catalyst $C_3$ obtained in Example 3 was used, reaction temperature was 520° C., the weight hourly space velocity was 16 $h^{-1}$, and the catalyst/oil weight ratio was 3. The results are shown in Table 3.

COMPARATIVE EXAMPLE 11

The present comparative example illustrates the cracking process using a prior catalyst.

The catalyst was deactivated according to the process of Example 8, and the same feedstock was catalytically cracked using the treated catalyst, except that a catalyst with trademark CRP-1, (available from the Catalyst Plant of Qilu Petrochemical Co.) for maximum olefins was used. The results are shown in Table 3.

TABLE 3

| Example No. | Example 8 | Comparative Example 11 |
|---|---|---|
| Catalyst | $C_3$ | CRP-1 |
| Conversion, wt % | 74.7 | 68.4 |
| Product yields, wt % | | |
| Gas | 41.9 | 38.2 |
| Coke | 2.3 | 1.6 |
| Gasoline | 30.5 | 28.6 |
| Light cycle oil | 13.6 | 16.5 |
| Slurry | 11.7 | 15.1 |
| Olefin yields, wt % | | |
| $C_2$ olefin | 2.39 | 0.73 |
| $C_3$ olefin | 15.55 | 14.91 |
| $C_4$ olefins | 16.24 | 16.04 |
| $C_2$–$C_4$ olefins | 34.18 | 31.68 |

The results in Table 3 show that the process according to the present invention not only has the advantage of a high conversion but also produces more olefins by changing the species and amounts of zeolites, and the yield of olefins is higher than that obtained using prior catalyst.

EXAMPLES 9–10

The following examples illustrate the cracking process according to the present invention.

The catalysts were deactivated according to the procedure in Example 7, and the same feedstock was catalytically cracked with the treated catalysts, except that Catalysts $C_2$ and $C_4$ obtained in Examples 2 and 4 were used respectively. The results are shown in Table 4.

COMPARATIVE EXAMPLE 12

The present comparative example illustrates the cracking process using a prior catalyst.

The catalyst was deactivated according to the process of Examples 9–10, and the same feedstock was catalytically cracked using the treated catalyst, except that an industrial catalyst with trademark of DVR-1 (a catalyst comprising RE ultrastable Y-molecular sieve, available from the Catalyst Plant of Qilu Petrochemical Co.) was used. The results are shown in Table 4.

TABLE 4

| Example No. | Example 9 | Example 10 | Comparative Example 12 |
|---|---|---|---|
| Catalyst | $C_2$ | $C_4$ | DVR-1 |
| Conversion, wt % | 82.1 | 82.3 | 70.9 |
| Product yields, wt % | | | |
| Gas | 14.4 | 14.3 | 12.3 |
| Coke | 1.7 | 1.3 | 1.3 |
| Gasoline | 66.0 | 66.7 | 57.3 |
| Light cycle oil | 13.0 | 13.2 | 14.4 |
| Slurry | 4.9 | 4.5 | 14.7 |
| Yield of light oils, wt % | 79.0 | 79.9 | 71.7 |

EXAMPLES 11–12

The following examples illustrate the cracking process according to the present invention.

Catalysts $C_5$ and $C_6$ obtained in Examples 5 and 6 were respectively mixed with an industrial catalyst (with the trademark of Orbit-3000, available from the Catalyst Plant of Qilu Petrochemical Co.) in a weight ratio of 20:80, the active component of Orbit-3000 being ultrastable Y-zeolite. The mixed catalysts were hydrothermally deactivated at 800° C. for 4 h with 100% steam, and then used to catalytically crack the same feedstock according to the process of Example 7. The results are shown in Table 5.

COMPARATIVE EXAMPLE 13

The present comparative example illustrates the cracking process only using an industrial catalyst.

The catalyst was deactivated according to the process of Examples 11–12, and the same feedstock was catalytically cracked using the treated catalyst, except that the catalyst used was not a mixture, but the industrial catalyst of with the trademark of Orbit-3000 alone. The results are shown in Table 5.

TABLE 5

| Example No. | Example 11 | Example 12 | Comparative Example 13 |
|---|---|---|---|
| Catalyst | 20% $C_5$ + 80% Orbit-3000 | 20% $C_6$ + 80% Orbit-3000 | 100% Orbit-3000 |
| Conversion, wt % | 75.1 | 76.6 | 71.2 |
| Product yields, wt % | | | |
| Gas | 12.8 | 13.3 | 13.1 |
| Coke | 3.9 | 4.1 | 3.5 |
| Gasoline | 58.4 | 59.2 | 54.6 |
| Light cycle oil | 14.2 | 13.9 | 13.7 |
| Slurry | 10.7 | 9.5 | 15.1 |
| Yield of light oils, wt % | 72.6 | 73.1 | 68.3 |

EXAMPLE 13

The following example illustrates the cracking process according to the present invention.

Catalyst $C_5$ obtained in Examples 5 was mixed with an industrial catalyst GOR comprising Y-zeolite (with the trademark of GOR, available from the Catalyst Plant of Qilu Petrochemical Co.) in a weight ratio of $C_5$:GOR=15:85, deactivated at 800° C. for 12 h with 100% steam.

The above mixed catalyst was used to catalytically crack a VGO blended with 34% atmospheric residue by a fixed fluidized bed (the properties of the feedstock are shown in Tables 6A and 6B), and the operation conditions were a reaction temperature of 510° C., a weight hourly space velocity of 8 $h^{-1}$, and a catalyst/oil weight ratio of 8. The results are shown in Table 7.

COMPARATIVE EXAMPLE 14

The present comparative example illustrates the cracking process using a prior catalyst.

The catalyst was deactivated according to the process of Examples 13, and the same feedstock was catalytically cracked using the treated catalyst, except that the catalyst used was an industrial catalyst of with the trademark of GOR alone. The results are shown in Table 7.

TABLE 6A

| Feedstock | VGO blended 34 wt % atmospheric residue |
|---|---|
| Density (20° C.), $g \cdot cm^{-3}$ | 0.9066 |
| Carbon residue, wt % | 3.20 |
| Pour point, ° C. | 40 |
| Viscosity, $mm^2 \cdot s^{-1}$ | |
| 100° C. | 11.0 |
| 80° C. | 18.83 |
| Element analysis, wt % | |
| C | 85.7 |
| H | 12.8 |
| S | 0.77 |
| N | 0.38 |

TABLE 6B

| Feedstock | VGO blended with 34 wt % atmospheric residue |
|---|---|
| Hydrocarbon group analysis, wt % | |
| Saturates | 57.5 |
| Aromatics | 24.5 |
| Gum | 16.9 |
| Asphaltene | 1.1 |
| Metal content, ppm | |
| Fe | 5.3 |
| Ni | 5.0 |
| Cu | 0.04 |
| V | 0.8 |
| Na | 1.2 |
| Distillation, ° C. | |
| IBP | — |
| 5% | 217 |
| 10% | 276 |
| 30% | 362 |
| 50% | 414 |
| 70% | 456 |
| 90% | 537 |
| Watson K factor | 12.0 |

TABLE 7

| Example No. | Example 13 | Comparative Example 14 |
|---|---|---|
| Catalyst | 15% $C_5$ + 85% GOR | 100% GOR |
| Conversion, wt % | 81.39 | 78.69 |
| Product yields, wt % | | |
| Dry gas | 1.03 | 1.22 |
| LPG | 18.73 | 19.02 |
| Coke | 7.81 | 7.55 |
| Gasoline | 53.82 | 50.90 |
| Light cycle oil | 15.06 | 15.29 |
| Slurry | 3.55 | 6.02 |
| Yield of light oils, wt % | 68.88 | 66.19 |

The present application claims priority under 35 U.S.C. § 119 of Chinese Patent Applications No. 01144959.4 filed on Dec. 25, 2001, and No. 01144960.8 filed on Dec. 25, 2001. The disclosures of each of the foregoing applications are expressly incorporated by reference herein in their entirety.

What is claimed is:

1. A cracking catalyst comprising layered clays, wherein said catalyst is prepared by a process consisting essentially of:

(1) mixing and slurrying an expandable clay, a modifier, pseudo-boehmite and water for 0.1–10 h to obtain a slurry comprising 10–40% by weight of solid, wherein various substances are added such that the resultant catalyst contains 1–98.8% by weight of the expandable clay, 0.1–50% by weight of the oxide derived from the modifier component, and 0.1–70% by weight of the alumina derived from pseudo-boehmite, based on the total weight of the catalyst, said modifier component is one or more selected from the group consisting of hydroxyl polymers of silicon, aluminum, zirconium, or titanium, and substances comprising one or more of said hydroxyl polymers;

(2) heating the slurry obtained in (1) to 50–85° C. and aging the slurry at this temperature for 0.1–10 h;

(3) drying and forming the slurry obtained in (2);

(4) water washing and aging the formed material obtained in (3) and filtering; and (5) drying and calcining the solid obtained in (4).

2. The catalyst according to claim 1, wherein said process for preparing the catalyst further comprises adding a kaolin family clay to said slurry at any time before drying and forming of the slurry in (3), and the amount of said kaolin family clay is selected such that the slurry contains 10–40% by weight of solid and 0–70% by weight of the kaolin family clay.

3. The catalyst according to claim 2, wherein said kaolin family clay is added before heating and aging of the slurry in (2), and the amount of the kaolin family clay is selected such that the resultant catalyst contains 0–50% by weight of the kaolin family clay.

4. The catalyst according to claim 2, wherein said kaolin family clay is selected from kaolin clay and/or halloysite.

5. The catalyst according to claim 1, wherein said process for preparing the catalyst further comprises adding a zeolite at any time before drying and forming of the slurry in (3), and the amount of the zeolite is selected such that the slurry contains 10–40% by weight of solid and the resultant catalyst contains 0–50% by weight of the zeolite.

6. The catalyst according to claim 5, wherein said zeolite is added after heating and aging in (2) and before drying and forming of the slurry in (3), and the amount of the zeolite is selected such that the resultant catalyst contains 0–40% by weight of the zeolite.

7. The catalyst according to claim 6, wherein said zeolite is one or more selected from the group consisting of faujasite, β-zeolite, ZSM series zeolites and mordenite.

8. The catalyst according to claim 7, wherein said zeolite is one or more selected from the group consisting of Y-zeolite, Y-zeolite comprising rare earth and zeolites having the ZSM-5 zeolite structure.

9. The catalyst according to claim 8, wherein said zeolite is one or more selected from the group consisting of ultrastable Y-zeolite, ultrastable Y-zeolite comprising rare earth and zeolites having the ZSM-5 zeolite structure.

10. The catalyst according to claim 1, wherein the amounts of said expandable clay, modifier component, pseudo-boehmite and water are selected such that the slurry before drying and forming contains 15–35% by weight of solid, and the resultant catalyst contains 20–70% by weight of expandable clay, 1–40% by weight of oxides derived from the modifier component and 3–40% by weight of the alumina derived from pseudo-boehmite.

11. The catalyst according to claim 1, wherein said time for stirring the slurry is 0.5–5 h.

12. The catalyst according to claim 1, wherein said temperature for aging the slurry is 50–75° C. and said time for aging the slurry is 0.5–5 h.

13. The catalyst according to claim 1, wherein said expandable clay is one or more selected from the group consisting of expandable monolayer mineral structure clays and regular interlayer mineral structure clays.

14. The catalyst according to claim 13, wherein said expandable monolayer mineral structure clay is one or more selected from the group consisting of montmorillonite, bentonite, hectorite, beidellite and vermiculite, and said regular interlayer mineral structure clay is one or more selected from the group consisting of mica-smectite, illite-smectite, glauconite-smectite, chlorite-smectite, mica-vermiculite and kaolinite-smectite.

15. The catalyst according to claim 14, wherein said regular interlayer mineral structure clay is one or more selected from the group consisting of rectorite, mica-montmorillonite, glauconite-montmorillonite, chlorite-montmorillonite, mica-vermiculite and kaolinite-montmorillonite.

16. The catalyst according to claim 15, wherein said regular interlayer mineral structure clay is rectorite.

17. The catalyst according to claim 16, wherein said rectorite is RE-rectorite, Na-rectorite and/or H-rectorite.

18. The catalyst according to claim 1, wherein the substances comprising one or more of said hydroxyl polymers are selected from alumina sol, silica sol and/or silica-alumina sol.

19. A process for cracking hydrocarbon oils, which comprises contacting hydrocarbon oils with a catalyst under the cracking conditions, wherein said catalyst is a cracking catalyst comprising layered clays according to claim 1, or a mixture of at least 1% by weight, based on the total weight of the mixture, of said cracking catalyst comprising layered clays and prior cracking catalyst.

20. The process according to claim 19, wherein said cracking conditions include a reaction temperature of 450–700° C., a weight hourly space velocity of 0.2–20 $h^{-1}$, and a catalyst/oil weight ratio of 2–12.

21. The process according to claim 20, wherein said reaction temperature is 460–680° C., weight hourly space velocity is 1–10 $h^{-1}$, and catalyst/oil weight ratio is 3–10.

22. The process according to claim 19, wherein said hydrocarbon oil is one or more selected from the group consisting of vacuum gas oil (VGO), atmospheric residue, hydrogenation tail oil, VGO blended with vacuum residue, VGO blended with atmospheric residue, VGO with coker gas oil, VGO blended with hydrogenation tail oil, and VGO blended with deasphalted oil.

23. The process according to claim 19, wherein the content of said cracking catalyst comprising layered clays is at least 5% by weight, based on the total weight of the mixture.

24. The process according to claim 23, wherein the content of said cracking catalyst comprising layered clays is at least 10% by weight, based on the total weight of the mixture.

25. The process according to claim 19, wherein said prior cracking catalyst is a cracking catalyst comprising one or more zeolites selected from the group consisting of faujasite, β-zeolite, ZSM-5 series zeolites, and mordenite.

26. The process according to claim 25, wherein said prior cracking catalyst is a cracking catalyst comprising one or more zeolites selected from the group consisting of Y-zeolite, RE Y-zeolite, and zeolites having the ZSM-5 zeolite structure.

27. The process according to claim 26, wherein said prior cracking catalyst is a cracking catalyst comprising one or more zeolites selected from the group consisting of ultrastable Y-zeolite, RE ultrastable Y-zeolite, and zeolites having the ZSM-5 zeolite structure.

28. A cracking catalyst comprising layered clays, wherein said catalyst is prepared by a process consisting of the following:

(1) mixing and slurrying an expandable clay, a modifier, pseudo-boehmite and water for 0.1–10 h to obtain a slurry comprising 10–40% by weight of solid, wherein various substances are added such that the resultant catalyst contains 1–98.8% by weight of the expandable clay, 0.1–50% by weight of the oxide derived from the modifier component, and 0.1–70% by weight of the alumina derived from pseudo-boehmite, based on the total weight of the catalyst, said modifier component is one or more selected from the group consisting of hydroxyl polymers of silicon, aluminum, zirconium, or titanium, and substances comprising one or more of said hydroxyl polymers;

(2) heating the slurry obtained in (1) to 50–850° C. and aging the slurry at this temperature for 0.1–10 h;

(3) drying and forming the slurry obtained in (2);

(4) water washing and aging the formed material obtained in (3) and filtering; and (5) drying and calcining the solid obtained in (4).

* * * * *